United States Patent [19]

Iijima et al.

[11] Patent Number: 4,977,069

[45] Date of Patent: Dec. 11, 1990

[54] SILVER HALIDE COLOR PHOTOGRAPHIC LIGHT SENSITIVE MATERIAL

[75] Inventors: Toshifumi Iijima, Kokubunji; Yoshitaka Yamada, Hino; Kenji Kumashiro, Hachioji; Hideo Akamatsu, Hachioji; Takashi Kamio, Hachiojo, all of Japan

[73] Assignee: Konishiroku Photo Industry Co., Ltd., Tokyo, Japan

[21] Appl. No.: 508,470

[22] Filed: Apr. 13, 1990

Related U.S. Application Data

[63] Continuation of Ser. No. 259,466, Oct. 18, 1988, abandoned, which is a continuation of Ser. No. 893,443, Aug. 5, 1986, abandoned, which is a continuation of Ser. No. 712,114, Mar. 15, 1985, abandoned.

[30] Foreign Application Priority Data

Mar. 16, 1984 [JP] Japan ..... 59-50571

[51] Int. Cl.[5] ..... G03C 1/46; G03C 1/76

[52] U.S. Cl. ..... 430/506; 430/507; 430/567; 430/568; 430/509

[58] Field of Search ..... 430/506, 507, 509, 567, 430/568

[56] References Cited

U.S. PATENT DOCUMENTS

| | | | |
|---|---|---|---|
| 3,658,536 | 4/1972 | Wolf | 430/506 |
| 3,663,228 | 5/1972 | Wyckoff | 430/506 |
| 3,902,905 | 9/1975 | Bissonette | 430/505 |
| 3,993,486 | 11/1976 | Oishi | 430/207 |
| 4,015,989 | 4/1977 | Oishi et al. | 430/606 |
| 4,184,876 | 1/1980 | Eeles et al. | 430/506 |
| 4,229,525 | 10/1980 | Ueda | 430/568 |
| 4,267,264 | 5/1981 | Lohmann | 430/506 |
| 4,369,248 | 1/1983 | Ranz et al. | 430/551 |
| 4,490,458 | 12/1984 | House et al. | 430/567 |
| 4,524,130 | 6/1985 | Iwasa et al. | 430/505 |
| 4,526,863 | 7/1985 | Mihayashi et al. | 430/506 |
| 4,599,302 | 7/1986 | Scheerer | 430/506 |

FOREIGN PATENT DOCUMENTS

| | | | |
|---|---|---|---|
| 2137372 | 10/1984 | United Kingdom | 430/506 |

*Primary Examiner*—Paul R. Michl
*Assistant Examiner*—Lee C. Wright
*Attorney, Agent, or Firm*—Finnegan, Henderson, Farabow, Garrett, and Dunner

[57] ABSTRACT

A silver halide color photographic light-sensitive material comprising a support having arranged thereon at least two each of red-sensitive layers, green-sensitive layers and blue-sensitive layers, wherein, with respect to each of the red-sensitive layers, the blue-sensitive layers and the green-sensitive layers, there are not less than two silver halide layers having different sensitivities, said material satisfying the following four requirements:

a. the highest blue-sensitive silver halide emulsion layer (BH) is arranged to serve as the silver halide emulsion layer in the farthest position from the support;
b. the highest green-sensitive silver halide emulsion layer (GH) and the highest red-sensitive silver halide emulsion layer (RH) are interposed between the highest blue-sensitive silver halide emulsion layer (BH) and a lower blue-sensitive silver halide emulsion layer (Bh);
c. the lowest green-sensitive layers (GL) and the lowest red-sensitive layer (RL) are present between the support and the lower blue-sensitive silver halide emulsion layer (Bh); and
d. a non-light-sensitive hydrophilic colloidal layer is arranged adjacently to the highest blue-sensitive silver halide emulsion layer (BH) with at least one of the highest blue-sensitive silver halide emulsion layer (BH) and the colloidal layer containing fine-grain silver halide particles.

10 Claims, No Drawings

SILVER HALIDE COLOR PHOTOGRAPHIC LIGHT SENSITIVE MATERIAL

This application is a continuation of application Ser. No. 07/259,466, filed Oct. 18, 1988, now abandoned, which was a continuation of application Ser. NO. 06/893,443 filed Aug. 5, 1986, now abandoned, which was a continuation of application Ser. No. 06/712,114 filed Mar. 15, 1985, now abandoned.

BACKGRROUND OF THE INVENTION

1. Technical Field of the Invention

This invention relates to a silver halide photographic light-sensitive material for color photographic use which is highly sensitive to light and excellently stable in processing.

More particularly, this invention relates to a silver halide color photographic light-sensitive material which is capable of displaying a high sensitivity to light and an excellent development stability.

2. Description of the Prior Art

There has so far been a demand for a silver halide color photographic light-sensitive material (hereinafter called light-sensitive material) which is to be highly sensitive. In recent years, in particular, there have been demands for developing a light-sensitive material which is highly sensitive and excellent in image qualities such as sharpness, graininess, interimage effects and the like, because there have been on the increase in opportunities for taking pictures under such a low light condition as an indoor condition or with a telephoto lens or a zoom-lens which is apt to cause a cawera blur, and besides the light-sensitive materials have been getting smaller in format.

It is, however, difficult to make a high sensitivity compatible with an image quality improvement.

To begin with, the following layer arrangements have been known for improving sensitivity or the like. For example, among the arrangements of light-sensitive layers coated on a support in the order of a red-sensitive layer a green-sensitive layer and a blue-sensitive layer, there is an arrangement of light-sensitive layers in which a part or the whole of the light-sensitive layers is separated into a high-sensitive silver halide emulsion layer (hereinafter called a high-speed emulsion layer) and a low-sensitive silver halide emulsion layer (hereinafter called a low-speed emulsion layer) each containing ballast couplers capable of color-developing the substantially same color-sensitive layer in the substantially same hue, and these emulsion layers are adjacently coated one over the other.

According to the above-mentioned arrangement, there are some problems of an emulsion layer relatively near by the support, including not only such a problem that an exposure amount is absorbed by other emulsion layers relatively far from the support before reaching the layer, but also a problem that it takes a relatively long time to diffuse a developer in the layer in course of development.

In other words, such a layer arrangement as mentioned above will cause a disadvantage that a green-sensitive layer and a red-sensitive layer each arranged to relatively lower position (to the support side) are hard to be highly sensitized by the less of the exposure amount and the delay in development.

On the other hand, there have been known arts of changing the layer arrangement order of each emulsion layer.

For example, U.S. Patent No. 3,663,228 discloses an arrangement in which (a) the low-speed emulsion layers of red-sensitive, green-sensitive and blue-sensitive (hereinafter collectively called a low-speed layer unit) are coated on a support in the above-mentioned order, (b) the high-speed emulsion layers of red-sensitive, green-sensitive and blue-sensitive (hereinafter collectively called a high-speed layer unit) are coated on the above-mentioned low-speed layer unit) so as to form a two-laminate unit, and the high-speed layer unit and the low-speed layer unit are separated from each other by an ND (neutral density) filter. As is apparent from the necesity for providing such an ND filter, no attention is paid at all by this art to any high sensitization.

Next, U.S. Pat. No. 3,658,536 discloses a technique for eliminating the less of an exposure quantity of a green-sensitive emulsion layer in such a way that the green-sensitive emulsion layer which will exert a potent influence upon a luminosity factor is positioned relatively farther from the front-surface of a support.

With this shifted layer arrangement, however, it cannot be achieved to highly sensitize a blue-sensitive emulsion layer.

Besides the above, as the other techniques for shifting layer arrangements, there are known those described in Japanese Patent Publication Open to Public Inspection (hereinafter called Japanese Patent O.P.I. Publication) Nos. 49027/1976 and 97424/1978, and U.S. Patent No. 4,129,446. In anyone of those techniques, a part of the color-sensitive layers is higher in sensitivity than the light-sensitive materials regularly arranged a red-sensitive layer, a green-sensitive layer and a blue-sensitive layer in order from the support side, however, the green-sensitive and/or red-sensitive emulsion layer of those techniques are insufficient not only in sensitivity but also in the effects of improving the image qualities such as graininess, sharpness and the like.

In addition to the above problems, there is a common and most serious point at issue of the above-mentioned techniques for shifting various layer arrangements that is, that the light-sensitive material prepared in those techniques will sharply respond to developing conditions so that a sensitization or desensitization in the toe portion and a disorder of the gradation are apt to cause.

OBJECT OF THE INVENTION

It is a principal object of the invention to provide a light-sensitive materials which is highly sensitized and, in addition, excellent in processing stability. To be more concrete, the object of the invention is to provide a light-sensitive material in which the sensitivity thereof obtained in point of Dmin+(0.4–0.8) is improved and the linearity of the gradation thereof is made excellent and, in addition, the processing stability thereof is improved.

The object of this invention can be achieved by the following constitution of the invention.

DETAILED DESCRIPTION OF THE INVENTION

This invention is constituted by satisfying the following four requirements, a, b, c and d, in a silver halide color photographic light-sensitive material comprising not less than two red-sensitive silver halide emulsion layers which are different in sensitivity from each other and not less than two blue-sensitive silver halide emulsion layers which are also different in sensitivity from each other, a. the highest blue-sensitive silver halide emulsion layer (BH) is to be arranged to the position farthest from the support, b. the highest green-sensitive silver halide emulsion layer (GH) and the highest red-sensitive silver halide emulsion layer (RH) are to be interposed between the highest blue-sensitive silver halide emulsion layer (BH) and a blue-sensitive silver halide emulsion layer (Bh) which is relatively lower in sensitivity than the emulsion layer (BH), or, if the Bh layer comprises two or more layers, the GH and RH layers are to be interposed between the layer closest to the BH layer and the BH layer.

c. none of the lowest blue-sensitive, green-sensitive and red-sensitive silver halide emulsion layers (BL, GL and RL, respectively) is not to be arranged to the farthest side from the support with respect to the blue-sensitive silver halide emulsion layer (Bh), and d. a non-light-sensitive hydrophilic colloidal layer is so arranged as to be adjacent to the blue-sensitive silver halide emulsion layer (BH), and fine-grain silver halide is contained in the emulsion layer (BH) and/or the colloidal layer.

The embodiments of this invention include an embodiment in which three of the blue-, green- and red-sensitive layers each comprise two silver halide emulsion layers which are different in sensitivity from each other. In this case, the blue-sensitive silver halide emulsion layer (Bh) is at one with the emulsion layer (BL).

The expression that the colloidal layer is so arranged as to be adjacent to the emulsion layer (BH) means in this invention that the colloidal layer of either a single layer or a laminated layer is so arranged as to be adjacent to either side of the emulsion layer (BH) without any interposition of other light-sensitive emulsion layers.

This adjacently arranged colloidal layer contains fine-grain silver halide of this invention. (In the case that the colloidal layer is multicoated with a plurality of layers, at least one of the plural layers contain the silver halide of this invention)

Now, the constituents of this invention will more concretely be described as follows:

One of the embodiments of the layer arrangements relating to this invention will be illustrated below.

Each of the blue-sensitive, green-sensitive and red-sensitive layers comprises less than every two of the respective three kinds of color sensitive silver halide emulsion layers which are different in sensitivity from each other (hereinafter simply called the emulsion layers which may be attached thereto with "color-sensitive", if occasion demands) to serve as the constituents. From the viewpoint that such a layer arrangement is for a finished light-sensitive material, a multilayered unit (H multilayered unit) is formed in such a manner that each of the highest sensitive blue-sensitive emulsion layer (BH), green-sensitive emulsion layer (GH) and red-sensitive emulsion layer (RH) is selected out from the color-sensitive emulsion layers, and the blue-sensitive emulsion layer (BH) is arranged so as to be adjacent to non-sensitive hydrophilic colloidal layer and the above-mentioned three layers are attached with auxiliary layers such as an interlayer, if necessary. This unit is arranged to the side farther from the support than the position of every unit mentioned below.

On the other hand, a multilayered unit (L multilayered unit) is formed in such a manner that at least the lowest sensitive emulsion layers (BL), (GL) and (RL) are selected out from each color-sensitive emulsion layers, and if necessary the above-mentioned at least three lowest sensitive layers are added thereonto with such an auxiliary layer as an interlayers. This unit is arranged to a position closest to the support as compared with the positions of the other units.

A multilayered unit (h multilayered unit) is formed in like manner that the color-sensitive emulsion layers (Bh), (Gh) and (Rh) which are lower in sensitivity than every color-sensitive emulsion layer of the H multilayered unit, are selected out from each color-sensitive emulsion layer, and are then arranged between the H multilayered unit and L multilayered unit. The h multilayered unit may be formed of n units of hi multilayered unit (in which $i=1, 2, \ldots, n$).

Among these embodiments, a particularly preferable one is that the above-mentioned n is 1 and the color-sensitive emulsion layers are multilayered from the support in the order of RL, GL, BL, Rh, Gh, Bh, RH, GH and BH.

There is another embodiment in which the h multilayered unit is not present herein but is present in the above-mentioned embodiment, and L multilayered unit and H multilayered unit are arranged in order, as the inevitable elements, on to a support.

In this embodiment, a particularly preferable arrangement is that the color-sensitive emulsion layers are arranged from the support in the order of RL, GL, BL, RH, GH and BH.

In the ranking of sensitivity of two or more emulsion layers of each color-sensitive layer of the invention which are different in sensitivity from each other, the sensitivity difference between the emulsion layers ranked next to each other is preferable to be gradually lowered according to $\log E=0.2$ to 1.0 from a high-sensitive emulsion layer to a low-sensitive emulsion layer.

In an emulsion layer comprising a plurality of layers for each color-sensitive layer described in each of the embodiments, the sensitivity of the emulsion layers are preferred to be lowered as they are getting closer to the support.

In some case, such a blue-sensitive, green-sensitive, or red-sensitive emulsion layer is not always required to provide into each of L and h multilayered units. It is, however, preferred to provide thereinto with three color-sensitive emulsion layers, respectively, and to arrange the red-sensitive emulsion layer so as to be close to a support. For example, the blue-sensitive, green-sensitive and red-sensitive emulsion layers are to be arranged in order toward the support.

In a variety of embodiments in which the above-mentioned layer arrangements relating to the invention, silver halide fine grains are contained in at least the highest-blue-sensitive emulsion layer (BH) and/or a non-sensitive hydrophilic colloidal layer provided adjacently to the layer (BH). In an embodiment to which the above-mentioned H' multilayered unit is provided, silver halide fine grains are contained in the highest-blue-sensitive emulsion layer (BH) and/or a colloidal layer provided adjacently to the layer (BH).

It is also allowed to contain such silver halide fine grains in an emulsion layer (Bh) which is lower in sensitivity than the blue-sensitive emulsion layer (BH) and- /or the colloidal layer provided adjacently to the layer (Bh).

As stated above, silver halide fine grains related to the invention are added at least to a non-sensitive hydrophilic colloidal layer provided adjacently to the highest-blue-sensitive emulsion layer (BH) and/or the blue-sensitive emulsion layer (BH).

Silver halide fine grains to be used in the blue-sensitive emulsion layer and/or the non-sensitive hydrophilic colloidal layer may be either of monodispersion type or polydispersion type. However, the monodispersion type grains are more preferred to achieve the objects effectively.

When the monodispersion type grains stated herein is represented by a grain-size distribution curve showing the relation between an average grain size $\bar{\gamma}$ and a standard deviation value s of the distribution curve, the preferable grains have a relation of $s/\bar{\gamma} \leqq 0.20$ and the more preferable ones have a relation of $s/\bar{\gamma} \leqq 0.15$.

The average grain-size of the fine grain silver halide is from 0.5 μm to 0.03 μm and preferably from 0.4 μm to 0.05 μm.

Silver halide of the fine grained silver halide may be composed of silver iodide, silver iodobromide, silver chloroiodobromide, silver bromide, or silver chlorobromide. The compositions and grain-sizes may be so selected as to be able to satisfactorily display the effects of this invention. The preferred composition is silver iodobromide or silver bromide that is preferred to be substantially non-sensitive. These may be prepared in any well-known process.

The quantity of fine grain silver halide to be used in the blue-sensitive emulsion layer and/or the non-sensitive hydrophilic colloidal layer may be determined arbitrarily. However, the quantity thereof to be used in the blue-sensitive emulsion layer is from 30 wt% to 5 wt% to the quantity of the to 10 wt%. The quantity thereof to be used in the non-sensitive hydrophilic colloidal layer is from 10mg(Ag)/dm$^2$ and more preferably from 5mg(Ag)/dm$^2$ to 2mg(Ag)/dm$^2$ The compositions and average grain-sizes of halogen of the to the layers to be used.

The most preferable layer arrangement of the invention is exemplified below, however, the invention shall not be limited thereto.

In the exemplification, N represents a non-light-sensitive hydrophilic colloidal layer, and +M represents to contain fine-grained silver halide.

Exemplification:

| A | B | C | D | E | F | G | H | I | J |
|---|---|---|---|---|---|---|---|---|---|
| N | N | N | N | N | N | N | N | N | N + M |
| BH + M | BH + M | BH | BH | BH + M | BH + M | BH + M | BH + M | BH | BH + M |
| N | N + M | N + M | N | N | N + M | N | N + M | N + M | N |
| GH | GH | GH | N + M | N | N | N + M | N + M | N + M | GH |
| N | N | N | GH | GH | GH | GH | GH | GH | N |
| RH | RH | RH | N | N | N | N | N | N | RH |
| N | N | N | RH | RH | RH | RH | RH | RH | N |
| BL | BL | BL | N | N | N | N | N | N | BL |
| N | N | N | BL | BL | BL | BL | BL | BL | N |
| GL | GL | GL | N | N | N | N | N | N | GL |
| N | N | N | GL | GL | GL | GL | GL | GL | N |
| RL | RL | RL | N | N | N | N | N | N | RL |
| N | N | N | RL | RL | RL | RL | RL | RL | N |
| Support | Support | Support | N | N | N | N | N | N | Support |
| | | | Support | Support | Support | Support | Support | Support | |

(note)
Non-light-sensitive hydrophilic colloidal layer which is provided adjacently to a blue-sensitive emulsion layer and is positioned to the support side may also be a yellow-filter layer.

In such an embodiment as described above, it is preferred to interpose a non-sensitive hydrophilic colloidal layer (an interlayer) between too color-sensitive layers which are adjacent to each other and are different in color-sensitivity from each other.

Such a non-light-sensitive colloidal layer may also contain a scavenger substance that is to react with and then deactivate the oxidants of a developing agent.

The preferable silver halide composition in such an emulsion layer as stated above is silver iodobromide or silver bromide and besides it may also be silver chlorobromide or silver chloroiodobromide.

It is preferred that the non-sensitive hydrophilic colloidal layers containing fine-grained silver halide relating to this invention are to be used within the range of from 0.4 μm to 2.0 μm in thickness after a light-sensitive material is completed. It is desired that the colloidal layers provided to the size closer to a support than the emulsion layer (BH) are within the range of from 0.5 μm to 1.2 μm in thickness.

As far as the grain-sizes of silver halide of an emulsion layer concerned, it is desired not to use small grains which cause a serious light-scattering, in each of the high-sensitivity (the high-sensitive multilayered units)

so as to reduce a sharpness deterioration caused to a layer positioning to the support side.

It is, therefore, desired that the average grain-size of silver halide in each of the high-light-sensitive layers is from 0.5 μm to 2.5 μm and particularly from 0.7 μm to 2.5 μm.

Meanwhile, it is preferred that the average grain-size of silver halide in each of the low-light-sensitive layers (the low-sensitive multilayered units) is from 0.2 μm to 1.5 μm and particularly from 0.2 μm to 1.0 μm. In this case that either one of the low-light-sensitive layers in divided into two layers, it is preferred that one layer is to be from 0.5 μm to 1.5 μm in thickness and the other lower-sensitive layer is to be in the order of from 0.2 μm to 1.0 μm in thickness.

It is a matter of indifference which of such silver halide grains of monodispersion type and those of polydispersion type are used. It is, however, preferred to use those of monodispersion type from the viewpoint of improving the grainness and sharpness of the grains.

In this case that the average of the grains is represented by $\bar{\gamma}$ and the standard deviation of the grain distribution is represented by $\gamma$, it is preferred that such a monodispersion type emulsion is not more than 0.2 in terms of the coefficient of variation $\sigma/\bar{\gamma}$.

There is also no limitation to the crystal structures of silver halide grains in the emulsion layers having the respective color-sensitivity. It is, therefore, possible to use the so-called core-shell type grains and otherwise.

There is further no limitation to how to process the emulsion layers having the respective color-sensitivity, but any of the well-known processes may be applied arbitrarily. Further, such as arbitrary substance as gelatin may be used to serve as the protective colloids to be used therein.

Emulsions of the emulsion layers having such color-sensitivity as mentioned above may be chemically sensitized in any publicly known process.

These silver halides are optically sensitized to be in a desired wavelength region with the use of cyanine dyes, merocyanine dyes or the like, so that the silver halides may be color-sensitized up to a desired degree.

It is also preferred that the emulsion layers having the respective color-sensitivity contain such a coupler as is corresponded to the color-sensitivity.

How to combine the couplers corresponding to the color-sensitivity may be carried out in accordance with any publicly known process, and as to the couplers capable of being used, any publicly known coupler may be used.

The amount of silver coated on each emulsion layer is of the order of from 4mg/dm$^2$ to 40mg/dm$^2$, and the amount of coupler is of the order of from 0.01 mol to 0.4 mol per mol of silver halide.

Further, an interlayers is interposed between the layers having the different color-sensitivity from each other so as to mentioned above, a hydrophilic binder such as gelatin or the like, and contains if necessary a scavenger and the like.

More detailedly describing of the light-sensitive material of the invention, any ordinary colored magenta couplers may be applied to the green-sensitive emulsion layers of the invention. As the above-mentioned colored magenta couplers, those described in U.S. Pat. Nos. 2,801,171 and 3,519,429, and Japanese Patent Examined Publication No. 27930/1973 may be used.

The following colored magenta couplers are preferably used in particular:

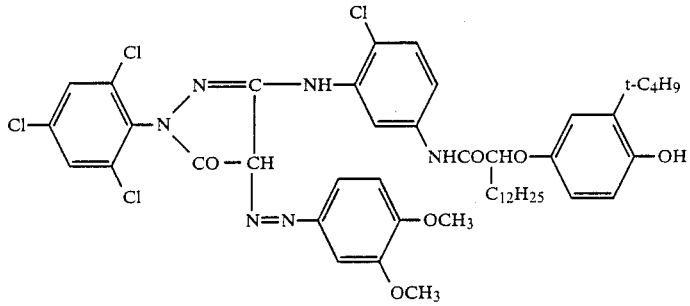

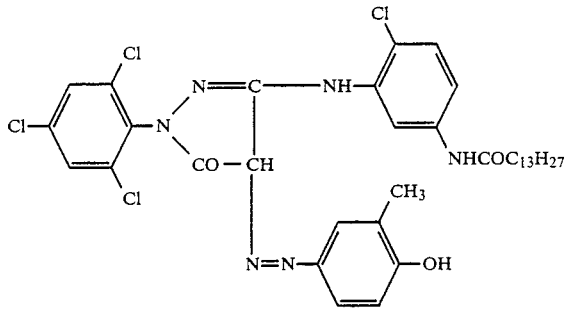

-continued

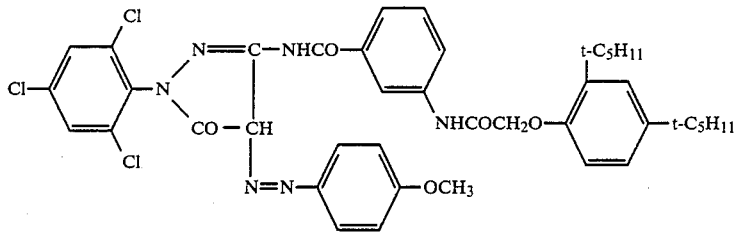

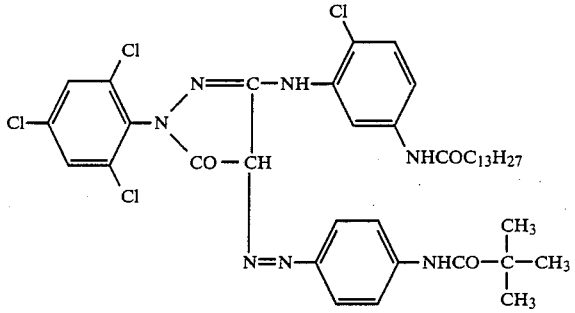

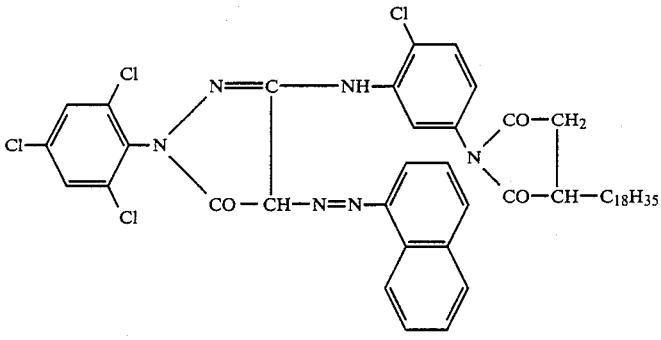

Any normal colored cyan couplers may be used for the red-sensitive layers of the invention. They include those described in Japanese Patent Examined Publication No. 32461/1980, British Patent No. 1,084,480, and the like.

The following colored cyan couplers may be given as the preferred ones to use:

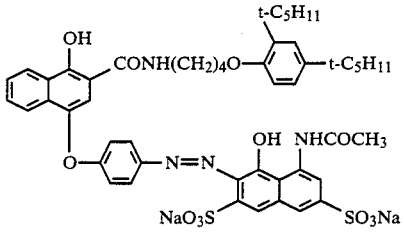

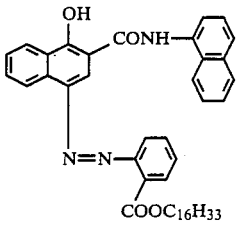

-continued

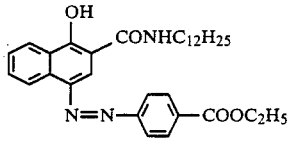

Any light-sensitive emulsion layer of the light-sensitive materials of the invention may contain color-forming couplers respectively corresponding to the emulsion layers.

It is generally preferred that the blue-sensitive layers of the invention contain couplers capable of forming yellow dyes. Any publicly known open-chain ketomethylene couplers may be used for the yellow color forming couplers. Among them a benzoylacetanilide compound and a pevaloylacetanilide compound may advantageously be used.

The concrete examples of yellow color forming couplers include those described in Japanese Patent O.P.I. Publication Nos. 26133/1972, 29432/1973, 87650/1975, 17438/1976, and 102636/1976; Japanese Patent Examined Publication Nos. 19956/1970, 33410/1976, 10783/1976 and 19031/1971; and U.S. Pat. Nos. 2,875,057, 3,408,194 and 3,519,429.

The particularly preferable couplers are given below:

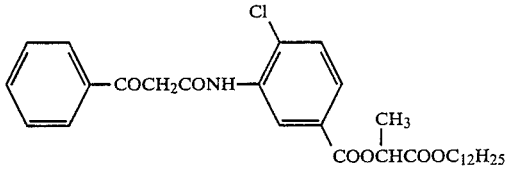
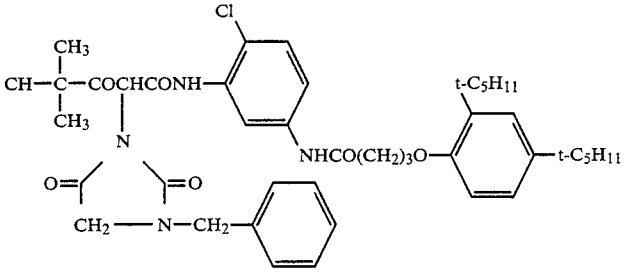
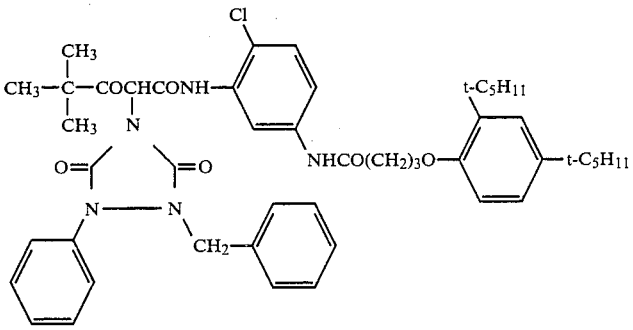
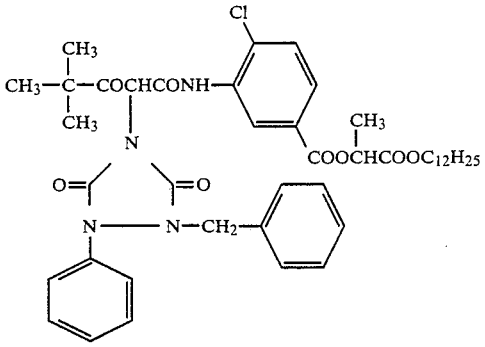
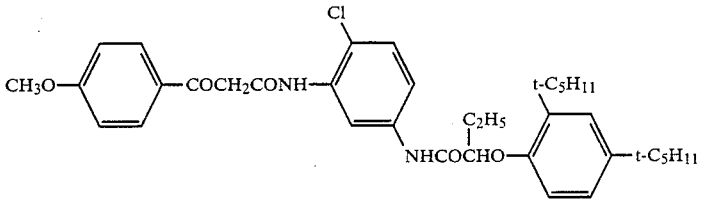
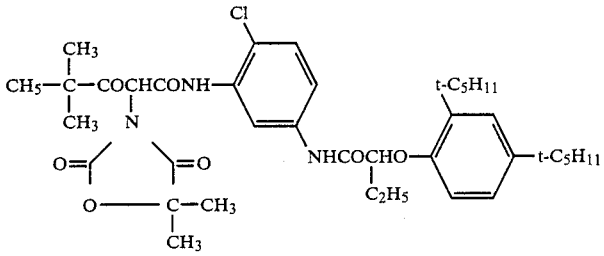

-continued
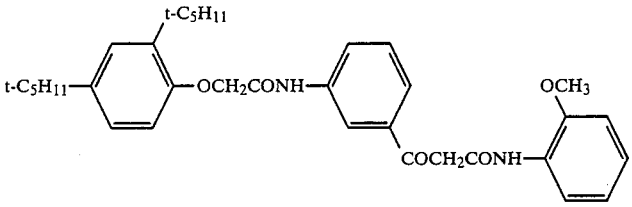
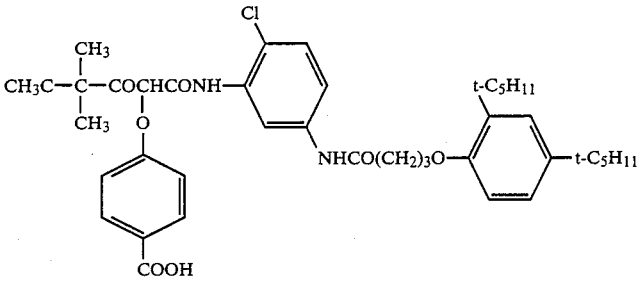
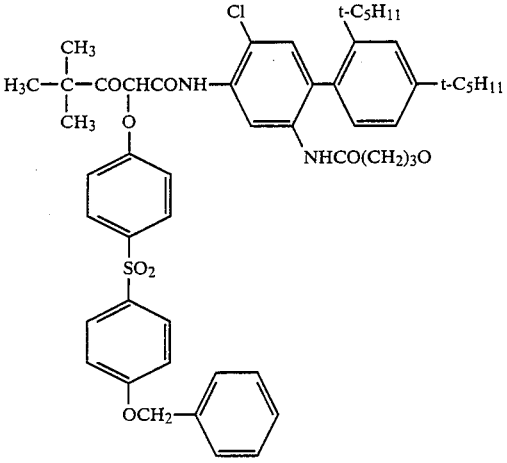
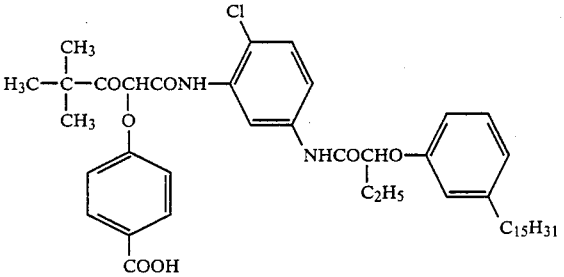
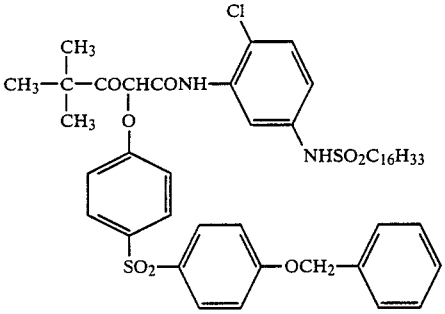

-continued

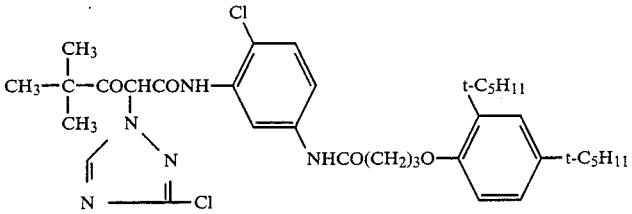

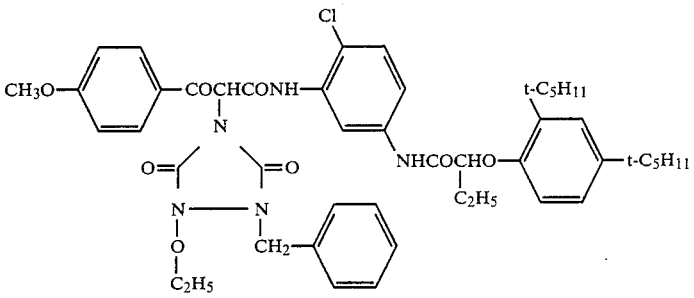

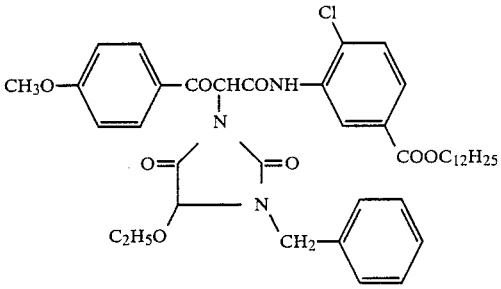

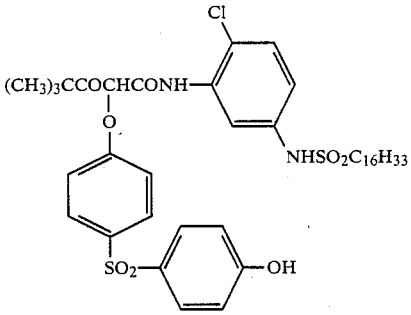

As for the magenta color-forming couplers to be used in the light-sensitive materials of the invention, a pyrazolone compound, a indazolone compound a cyanacetyl compound, a pyrazolotriazole compound and the like may be used. Among them, the pyrazolone compounds are particularly advantageous.

The concrete examples of the usable magenta color-forming couplers include those described in Japanese Patent O.P.I. Publication Nos. 111631/1974, 29236/1981, and 94752/1982; Japanese Patent Examined Publication No. 27930/1973; U.S. Pat. Nos. 2,600,788, 3,062,653, 3,408,194 and 3,519,429; Research Disclosure No. 12443; and the like.

The particularly preferable couplers are as follows:

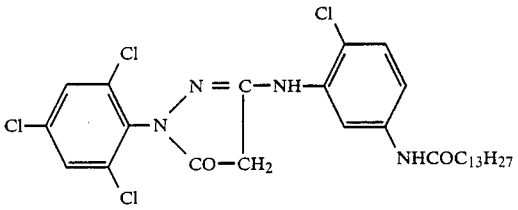

-continued
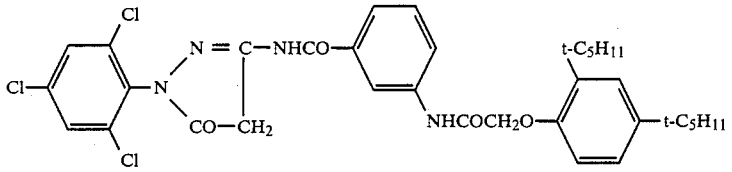
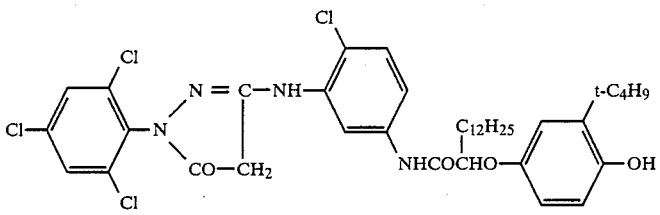
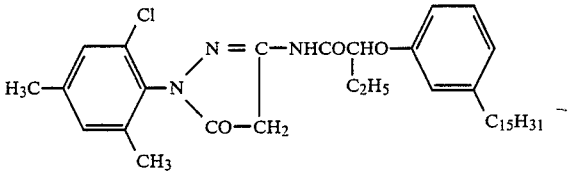
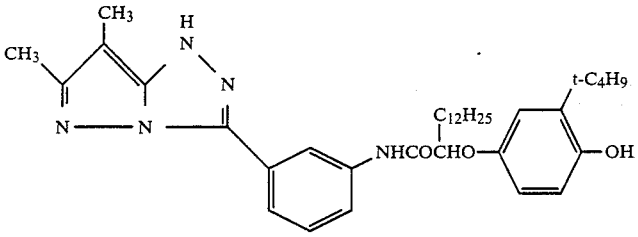
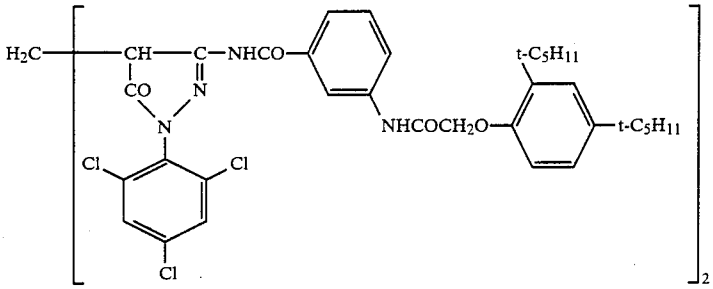
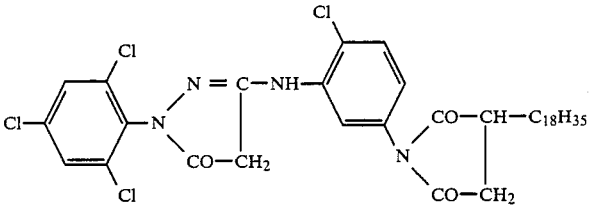
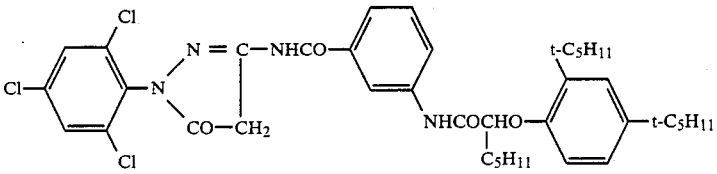

-continued
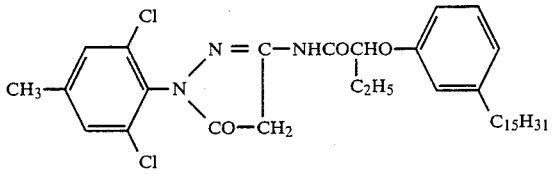
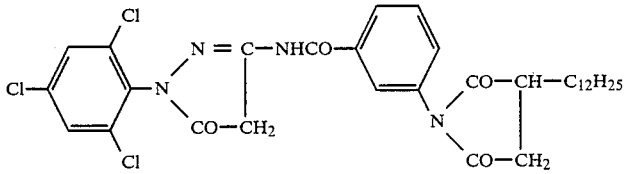
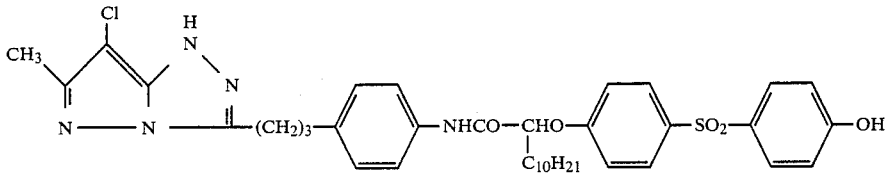
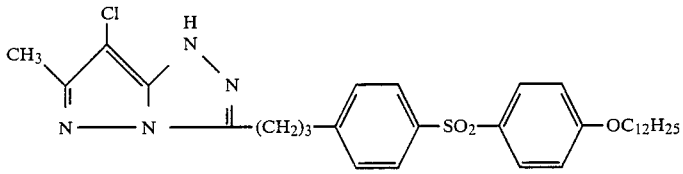
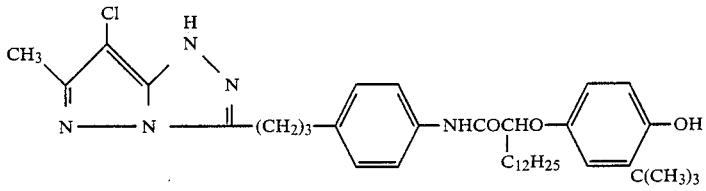
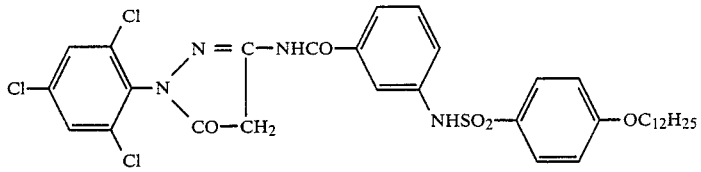
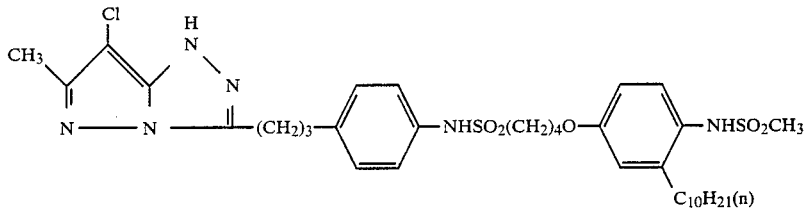
As for the cyan color-forming couplers to be used in the light-sensitive materials of the invention, a phenol compound, a naphthol compound and the like may be used.
The concrete examples thereof include those described in U.S. Pat. Nos. 2,423,730, 2,474,293 and 2,895,826; Japanese Patent O.P.I. Publication NO. 117422/1975; and the like.
The particularly preferable couplers are as follows:

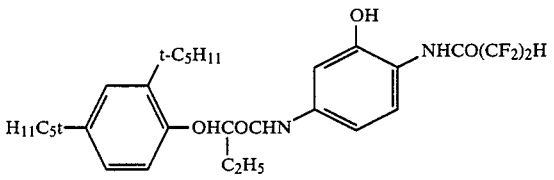
OH
NHCO(CF2)2H
t-C5H11
H11C5t
OHCOCHN
C2H5
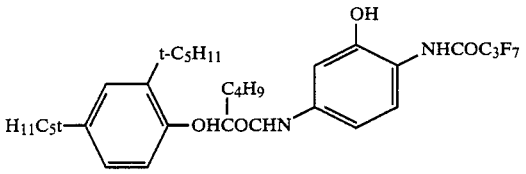
OH
NHCOC3F7
t-C5H11
C4H9
H11C5t
OHCOCHN
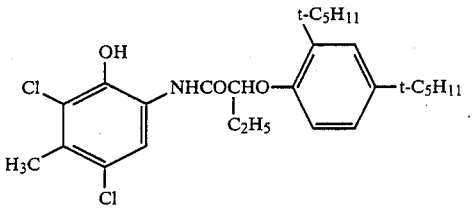
t-C5H11
OH
Cl
NHCOCHO
t-C5H11
C2H5
H3C
Cl
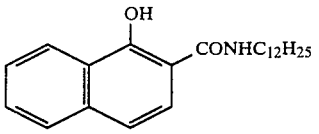
OH
CONHC12H25
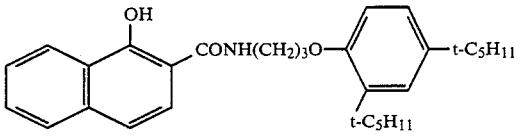
OH
CONH(CH2)3O
t-C5H11
t-C5H11
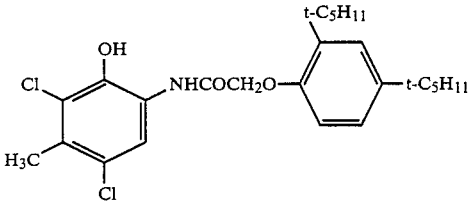
t-C5H11
OH
Cl
NHCOCH2O
t-C5H11
H3C
Cl
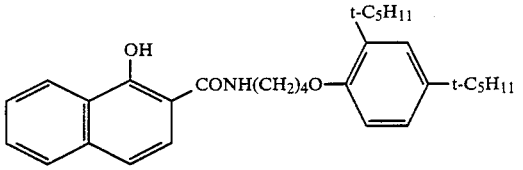
t-C5H11
OH
CONH(CH2)4O
t-C5H11
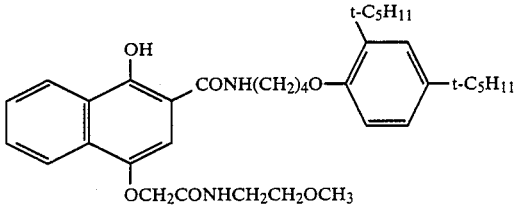
t-C5H11
OH
CONH(CH2)4O
t-C5H11
OCH2CONHCH2CH2OCH3

-continued
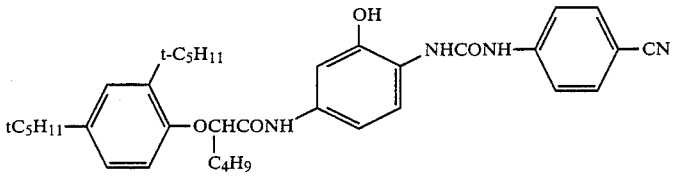
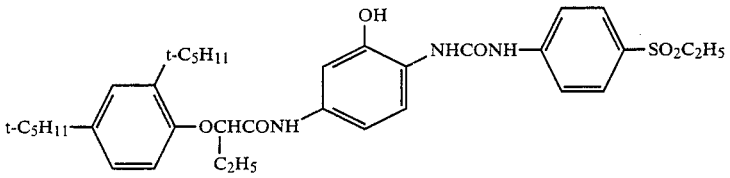
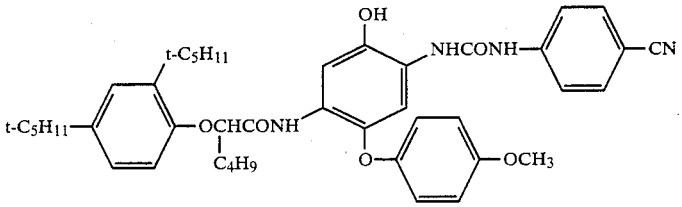
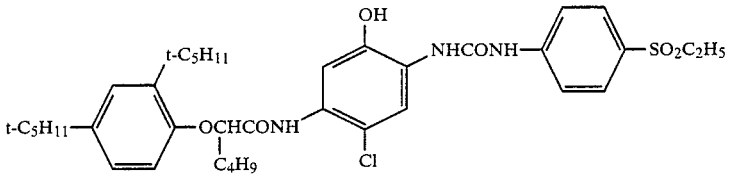
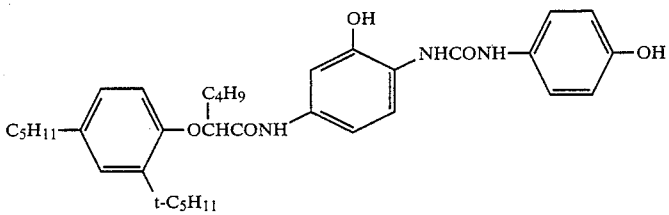
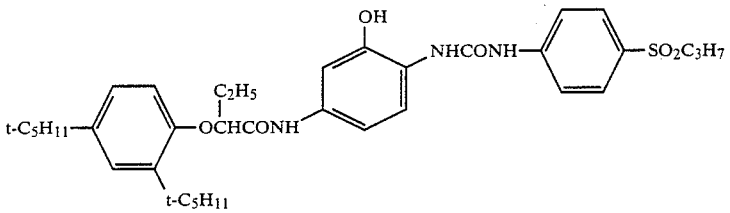
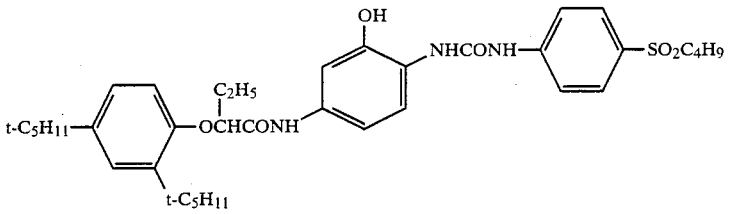

-continued

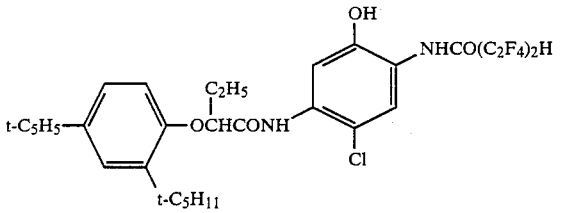

One and the same layer may contain not less than two kinds of the above exemplified couplers, while not less than two different layers may contain the same kind of the compounds.

How to contain the couplers in an emulsion layer is publicly known. In this invention, it is also possible to follow such a publicly known adding process.

To the emulsion layers of the invention may be added with a non-diffusing compound (a DID compound) capable of reacting of the oxidants of a developing agent and then releasing a diffusion type development inhibitor compound.

As for the DIR compounds, those described in Japanese Patent O.P.I. Publication Nos. 82,424/1977, 145,135/1979 and 151,944/1982; U.S. Pat. Nos. 2,327,554, 3,227,554 and 3,615,506; Japanese Patent Examined Publication No. 16,141/1976; and the like may advantageously be used.

The particularly preferable DIR compounds are given as follows:

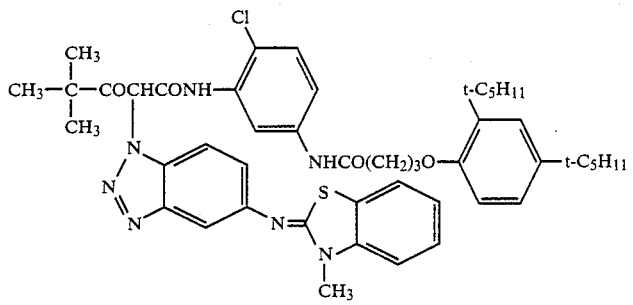

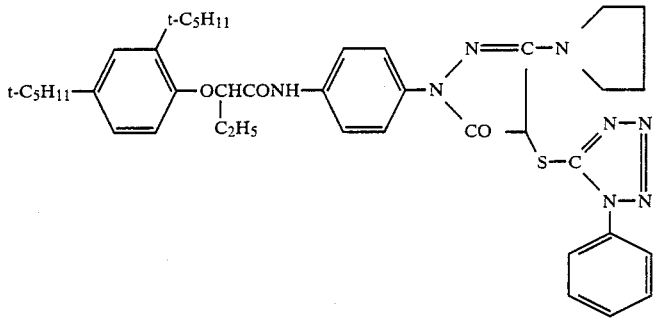

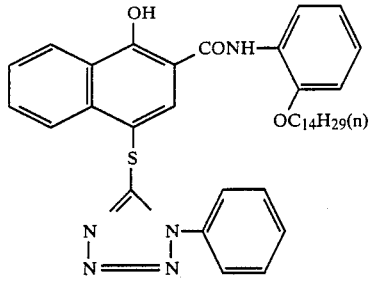

-continued

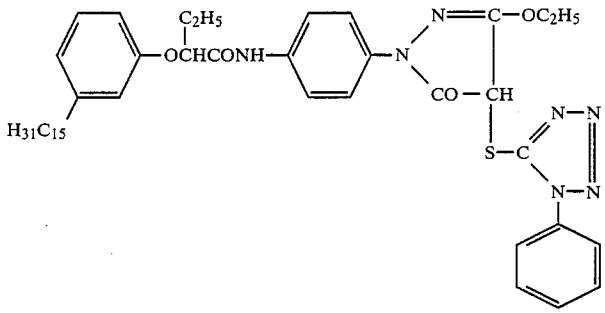

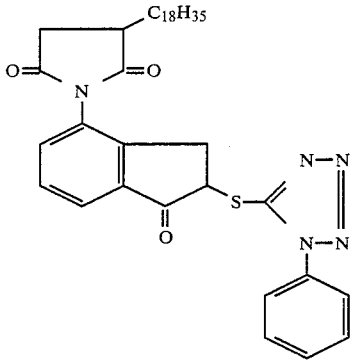

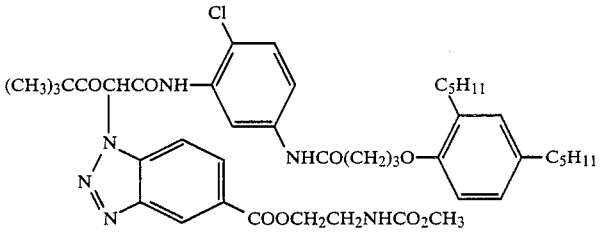

When a light-sensitive material of the invention is provided with a non-light-sensitive interlayer, it is also allowed that any photographic component layers including the interlayers may contain such a photographic additive as an antistaining agent. As for the antistaining agents, those compounds described in Japanese Patent O.P.I. Publication No. 2,128/1971; U.S. Pat. No. 2,728,659; and the like may advantageously be used. The following compounds are particularly preferable to be used:

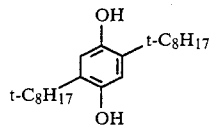

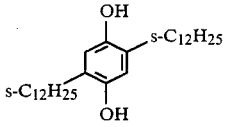

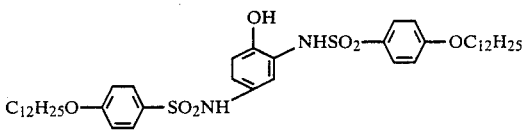

-continued

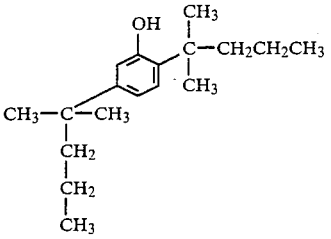

Silver halide emulsions to be used in the light-sensitive silver halide emulsion layers of the invention may be chemically sensitized. They are processed is such a process as has so far been carried out.

Namely, such a chemical sensitization can be made independtly or in combination with such a chemical sensitizer as an active gelatin; a noble-metal sensitizer including a water-soluble gold salt, a water-soluble platinum salt, a water-soluble paradium salt, a water-soluble rhodium salt, a water-soluble iridium salt and the like; a sulfur sensitizer; a selenium sensitizer; a reduction sensitizer including a polyamine, stannous chloride; and the like.

In addition to the above, the silver halide can also optically be sensitized up to a desired wavelength region. For example, they can optically be sensitized by making use, independently or in combination, of such an optical sensitizer including, for example, a cyanine dye or a merocyanine dye such as zeromethine dye, monomethine dye, dimethine dye, trimethine dye and the like (For example, a hyper color sensitization).

In the light-sensitive materials of the invention, the light-sensitive emulsion layers and/or the other component layers thereof (such as the auxiliary layers including the interlayers, subbing layers, filter layers, protective layers, image receiving layers and the like) may contain a variety of photographic additives so as to meet the purposes.

For example, stabilizers or antifoggants such as azaindenes, triazoles, tetrazoles, imidazolium salts, tetrazolium salts, polyhydroxy compounds;

Hardners such as aldehydes, aziridines, inoxazoles, vinyl sulfones, acryloyls, carbodiimides, maleimides, metharesulfonic acid esters, triazines;

Development accelerators include such compounds as benzyl alcohol, polyoxyethylenes;

Image stabilizers such as chromans, coumarans, bisphenols and phosphorous esters; Lubricants such as waxes, glyceride of higher fatty acid, higher alcohol esters of higher fatty acid.

Surfactants include auxiliary coating agents, emulsifiers, improvers for permeability to processing liquid, defoaming agents or compounds for controlling physical property of light-sensitive materials which are of anion cation, nonionic or amphoteric type.

As for mordants, N-guanylhydrazone type compound, quaternary onium salt compound are useful.

Antistatic agents include diacetyl cellulose, styrene-perfluroalkyl lithium maleate copolymer, alkali salts of reaction product of styrene maleic anhydride copolymer and p-amino benzenesulfonic acid and the like.

Anticolor-turbidity agents include polymers having vinylpyrrolidone monomers, polymers having vinylimidazole monomers or the like. Matting agents include polymethyl methacrylate, polystyrene, alkali soluble polymer and the like. And further colloidal silicon oxide may be used.

Latexes useful for improving physical properties of layer include copolymers of acrylic acid esters, vinyl esters, etc., with other monomers having an ethylene group.

Gelatin plasticizers include glycerol and glycol type compounds. Thickening agents include styrene-sodium maleate copolymer, alkyl vinyl ether-maleic acid copolymer and the like.

The light-sensitive material of the invention may be produced by coating on the support silver halide emulsion layers and other component layers in which above-described various photographic additives are added as occasion demands. Materials usable as the support include, for example, baryta paper, polyethylene-coated paper, polypropylene-synthetic paper, glass paper, cellulose acetate, cellulose nitrate, polyvinyl acetal, polypropylene, polyester film such as of polyethylene terephthalate, polystyrene, and the like. One suitable for the purpose for which the light-sensitive material is used is selected from among these materials.

Any of these support materials may, if necessary, be subjected to subbing treatment.

The light-sensitive material of the invention may be developed by the conventionally known method ater exposure. Namely, it may be color-developed by the known color developing method.

In the reversal method, the light-sensitive material is developed first with monochromatic negative developer, then exposed to white light or processed in a bath containing antifoggants and lastly color-developed with alkali developer containing color developing agent.

Processing method has no particular limit and various processing methods may be applied, for example, the method in which the light-sensitive material is subjected to bleach-fix treatment after color development and then to washing and stabilizing process of occasion demands, and the method in which bleaching and fixing are made separately after color development and then, if necessary, washing and stabilizing treatment are done.

Amplifier agents such as hydrogen peroxide and cobalt complex salt may be used for processing the light-sensitive materials.

Above method is applied in some cases under high temperature in order to process rapidly, and in other cases under room temperature or below in special cases. When rapidly processing under high temperature, hardening treatment may be done in advance.

Various auxiliary baths such as neutralizing bath may in some cases be needed in accordance with the processing agents used for each purpose, and these auxiliary baths may arbitrarily be used if necessary.

Color developing agents useful for the invention include primary phenylenediamines and the derivatives thereof such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamido ethylaniline, 3-methyl-4-amino-N-ethyl-N-β-methoxyethylaniline, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamide-4-amino-N,N-diethylaniline, 4-amino-N,N-dimethylaniline, N-ethyl-N-β-[β-(β-methoxyethoxy)ethoxy]-ethyl-3-methyl-4-aminoaniline, N-ethyl-N-β(β-methoxyethoxy)-ethyl-3-methyl-4-aminoaniline) and the salts thereof such as sulphate, hydrochloride, sulphite and p-toluenesulfonate.

IV. Concrete Effects of the Invention

According to the invention, a very high speed light-sensitive material can be prepared on which the sensitivity of Dmin +(0.4−0.8) can markedly be improved in addition to the sensitization of the sensitivity in the toe portion of the characteristic curve thereof (Dmin+0.1), and therein, the linearity of the gradation is also markedly excellent.

Further, such an effect as has not been anticipated can be materialized in that the processing stability can be greatly improved.

Still further, the light-sensitive materials of the invention are useful for a variety of applications and, in particular, useful for a color-negative film.

V. Concrete Examples of the Invention

The invention will now be described in more detail with reference to the concrete examples of the invention given below:

For reference, in everyone of the following examples, any amount added in a light-sensitive material will be represented in terms of an amount per square-meter. Any amount of a silver halide and a colloidal silver will be converted into an amount of the silver thereof.

EXAMPLE

According to the layer arrangements listed up in Table 1 below, multilayered color film samples Nos. 1 through 10 were prepared by coating the layers over to the supports coated in advance with the anti-halation layers, respectively.

In Table 1, B, G, R, H, L have the same meaning as aforementioned. I is an interlayer; Y is a yellow-filter layer; Pr is a protective layer; and Base is a support. And, M is fine-grain silver halide.

In addition, asterisks each attached to BH, GH, RH indicate that every light-sensitive silver iodobromide emulsion held in each of the layers comprises a monodispersion type emulsion.

TABLE 1

| Sample No. | 1 (Comparison) | 2 (Comparison) | 3 | 4 | 5 | 6 | 7 | 8 | 9 | 10 |
|---|---|---|---|---|---|---|---|---|---|---|
| Upper layer | Pr | Pr | Pr + M(A) | Pr | Pr | Pr | Pr | Pr | Pr | Pr |
| | BH | BH | BH | BH | BH + M(B) | BH | BH + M(B) | BH | BH + M(B) | BH* + M(B) |
| ↑ | BL | I | I | I + M(A) | I + M(A) | I | I | I + M(A) | I | I + M(A) |
| | Y | GH | GH | GH | GH | I + M(A) | I + M(A) | I + M(A) | I + M(A) | GH* |
| | GH | I | I | I | I | GH | GH | GH | RH | I |
| | I | RH | RH | RH | RH | I | I | I | I | RH* |
| | GL | I | I | I | I | RH | RH | RH | GH | I |
| | I | BL | BL | BL | BL | I | I | I | I | BL |
| | RH | I | I | I | I | BL | BL | BL | BL | I |
| | I | GL | GL | GL | GL | I | I | I | I | GL |
| | RL | I | I | I | I | GL | GL | GL | GL | I |
| | Base | RL | RL | RL | RL | I | I | I | I | RL |
| | | Base | Base | Base | Base | RL | RL | RL | RL | Base |
| | | | | | | Base | Base | Base | Base | |

In Table 1, each of the layers is as follows:

RL

This is a low-speed red-sensitive emulsion layer comprising 0.7g of a red-sensitized emulsion (Emulsion I) comprising AgBrI containing AgI of 2 mol%, of which the average grain size ($\gamma$) was 0.40 $\mu$, and the coefficient of variation ($\sigma/\gamma$) was 0.18;

0.7g of another red-sensitized emulsion (Emulsion II) comprising AgBrI containing AgI of 4 mol%, of which the $\gamma$ was 0.80 $\mu$ and the $\sigma/\gamma$ was 0.20, 2.2g of gelatin; and a dispersed material prepared in such a process that 1.0g of 1-hydroxy-4-[$\beta$-(methoxyethyl)aminocarbonyl]-methoxy-N-[$\delta$-(2,4-di-t-amylphenoxy)butyl]-2-naphthamide (C-1), 0.075g of 1-hydroxy-4-4-(1-hydroxy-8-acetamide-3,6-di- sulfo-2-naphthylazo)phenoxy]-N-[$\delta$-(2,4-di-t-amylphenoxy)butyl-2-naphthamide disodium (CC-1), 0.01g of 1-hydroxy-2-[$\delta$-(2,4-di-t-amylphenoxy)-n-butyl]naphthamide (C-2), and 0.07g of 2-bromo-4-(2,2,3,3,4,4,5,5,6,6,7,7,8,8,9,9-hexadeca fluorononanoylamino)-7-nitro-2-(1-phenyl-5-tetrazolylthio)-1-indanone (D-1) were dissolved into 0.8g tricresyl phosphate (TCP) and the solution wa then emulsion-dispersed in an aqueous solution containing 2.2g of gelatin.

RH

This is a high-speed red-sensitive emulsion layer comprising 1.5g of a red-sensitized silver iodobromide emulsion (Emulsion III) made of AgBrI containing AgI of 6 mol%, of which $\gamma$ was 1.50 $\mu$ and $\sigma/\gamma$ was 0.40; and a dispersed material prepared in such a process that 0.26g of cyan coupler (C-1) and 0.03g of colored cyan coupler (CC-1) into 0.30g of TCP were emulsion-dispersed into an aqueous solution containing 1.2g of gelatin.

GL

This is a low-speed green-sensitive emulsion layer comprising 0.7g of two kinds of Emulsions prepared by green-sensitizing Emulsions I and II respectively; and a dispersed material prepared in such a process that 0.8g of 1-(2,4,6-trichlorophenyl)-3-[3- 2,4-di-t-amylphenoxy acetamide)benzamide]-5-pyrazolone (M-1), 0.15g of 1-(2,4,6-trichlorophenyl)-4-(naphthylazo)-3-2-chloro-5-octadecenyl succinimidaniline)-5-pyrazolone (CM-1), and 0.012g of DIR compound (D-1) were dissolved in 0.95g of TCP and the solution thereof was emulsion-dispersed in an aqueous solution containing 2.2 g of gelatin.

GH

This is a high-speed green-sensitive emulsion layer comprising 1.6 g of an emulsion prepared by green-sensitizing Emulsion III, and a dispersed material prepared in such a process that 0.20 g magenta couplers (M-1) and 0.049 g of colored magenta couplers (CM-1) were dissolved in 0.25 g of TCP and the solution thereof was emulsion-dispersed in an aqueous solution containing 1.9 g of gelatin.

BL

This is a low-speed blue-sensitive emulsion layer comprising 0.5g of Emulsion III which was the blue-sensitized Emulsion II, and a dispersed material prepared in such a process that 1.5 g of $\alpha$-pivaloyl-$\alpha$-(1-benzyl-2-phenyl-3,5-dioxo-imidazolidine-4-yl)-2'-chloro-5'[$\alpha$-dodecyloxy carbonyl)ethoxy-carbonyl]acetanilide (Y-1) were dissolved in 0.6 g of TCP and the solution thereof was emulsion-dispersed in an aqueous solution containing 1.9 g of gelatin.

BH

This is a high-speed blue-sensitive emulsion layer comprising 0.8 g of an emulsion prepared by blue-sensitizing Emulsion III, and a dispersed material prepared in such a process that 1.30 g of yellow couplers (Y-1) were dissolved in 0.65 g of TCP and the solution thereof was emulsion-dispersed in an aqueous solution-containing 1.5 g of gelatin.

RH* GH* and BH*

These are the emulsion layers in which the above-mentioned Emulsions III for RH, GH and BH were replaced respectively by the emulsions comprising AgBrI of which the AgI contents were 6 mol%, the average grain size was 1.80 $\mu$ and the $\sigma/\bar{\gamma}$ was 0.12.

I

This is an interlayer containing 0.8 g of gelatin, and dibutylphthalate (DBP) in which 0.07 g of 2,5-di-t-octylhydroquinone (HQ-1) were dissolved.

Y

This is a yellow-filter layer containing 0.15 g of yellow colloidal silver, 0.11 g of DBP in which 0.2 g of an antistaining agent (HQ-1) were dissolved, and 1.5 g of gelatin.

Pr

This is a gelatin protective layer.

Further, fine-grain silver halide M(A) was an AgBrI emulsion of which the $\bar{\gamma}$ was 0.088 $\mu$, the $\sigma/\bar{\gamma}$ was 0.14 and the AgI contents were 2 mol%, and fine-grain silver halide M(B) was an AgBrI emulsion of which the $\bar{\gamma}$ was 0.27 $\mu$, the $\sigma/\bar{\gamma}$ was 0.15 and the AgI contents were 2 mol%.

To a non-light-sensitive hydrophilic colloidal layer was added with 4 mg of the fine-grain silver halide M(A) per $dm^2$ of the colloidal layer, and to a light-sensitive emulsion layer was added with 5 mg of the fine-grain silver halide M(B) per $dm^2$ of the emulsion layer.

Each of the Samples No. 1 through 9 thus prepared was exposed to blue-, green- and red- light through an optical wedge, and was then processed in the following steps:

| Step (at 38° C.) | Time | |
|---|---|---|
| Color developing | 3 min. | 15 sec. |
| Bleaching | 6 | 30 |
| Washing | 3 | 15 |
| Fixing | 6 | 30 |
| Washing | 3 | 15 |
| Stabilizing | 1 | 30 |
| Drying | | |

The composition of each processing liquids used in the above-mentioned steps is as follows:

| | |
|---|---|
| [Color Developer] | |
| 4-amino-3-methyl-N-ethyl-N-($\beta$-hydroxyethyl)-aniline sulfate | 4.75 g |
| Sodium sulfite, anhydrated | 4.25 g |
| Hydroxylamine ½ sulfate | 2.0 g |
| Potassium carbonate, anhydrated | 37.5 g |
| Sodium bromide | 1.3 g |
| Trisodium nitrilotriacetate, monohydrated | 2.5 g |
| Potassium hydroxide | 1.0 g |
| Add water to make | 1,000 cc |
| [Bleaching agent] | |
| Iron ammonium ethylenediamine tetraacetate | 100.0 g |
| Diammonium ethylenediamine tetraacetate | 10.0 g |
| Ammonium bromide | 150.0 g |
| Glacial acetic acid | 10.0 ml |
| Add water to make | 1,000 cc |
| Adjust pH with aqueous ammonia to pH 6.0 | |
| [Fixer] | |
| Ammonium thiosulfate | 175.0 g |
| Sodium sulfite, anhydrated | 8.5 g |
| Sodium metasulfite | 2.3 g |
| Add water to make | 1,000 cc |
| Adjust pH with acetic acid to pH 6.0 | |
| [Stabilizer] | |
| Formalin (in 37% aqueous solution) | 1.5 ml |
| Koniducks (mfd. by Konishiroku photo Ind. Co., Ltd., Japan) | 7.5 ml |
| Add water to make | 1,000 cc |

Table 2 shows the $S_1$ sensitivity and $S_2$ sensitivity thus obtained. The $S_1$ and $S_2$ are represented by the reciprocal values relative to that of Sample No. 1 of an exposure quantity which will give the density of Dmin+0.1 and Dmin+0.5, provided that Dmin denotes a minimum density in the cases of $S_1$ and $S_2$, respectively.

These relative reciprocals of blue-light (B), green-light (G) and red-light (R) are shown in Table 2 below:

TABLE 2

| Light used | Characteristic Value | 1 (Comparative) | 2 (Comparative) | 3 | Sample No. 4 | 5 | 6 | 7 | 8 | 9 | 10 |
|---|---|---|---|---|---|---|---|---|---|---|---|
| B | $S_1$ Sensitivity | 100 | 100 | 105 | 110 | 115 | 108 | 110 | 109 | 111 | 139 |
| | $S_2$ Sensitivity | 100 | 88 | 101 | 116 | 112 | 110 | 109 | 108 | 109 | 135 |
| G | $S_1$ Sensitivity | 100 | 118 | 120 | 128 | 129 | 125 | 125 | 128 | 126 | 178 |
| | $S_2$ Sensitivity | 100 | 94 | 95 | 120 | 120 | 119 | 118 | 121 | 120 | 170 |
| R | $S_1$ Sensitivity | 100 | 117 | 118 | 118 | 115 | 120 | 120 | 119 | 128 | 181 |
| | $S_2$ Sensitivity | 100 | 92 | 91 | 109 | 110 | 112 | 111 | 109 | 120 | 178 |

From the results shown in Table 2, it is found that both of $S_1$ and $S_2$ of the light-sensitive materials (Sample No. 3–10) of the invention can be very excellent. It is also found that a very great effect can be enjoyed when every high-sensitive layer contains a monodisperse emulsion, like Sample No. 10.

EXAMPLE 2

Samples No. 1 through 10 were exposed to light through an optical wedge and were then processed, in the like manner in the case of Example 1, by making use of the similar color-developer used in Example 1 except that the sodium bromide content only was changed to 1.6 g.

The $S_1$ and $S_2$ sensitivity of the respective samples obtained are shown in Table 3 so that the values thereof denote the relative values to the values of the sensitivity obtained in Example 1.

TABLE 3

| Amt. of NaBr | Light used | Characteristic Value | 1 | 2 | 3 | 4 | 5 | 6 | 7 | 8 | 9 | 10 |
|---|---|---|---|---|---|---|---|---|---|---|---|---|
| | B | $S_1$ Sensitivity | 63 | 63 | 71 | 72 | 74 | 72 | 73 | 71 | 74 | 75 |
| | | $S_2$ Sensitivity | 58 | 59 | 70 | 70 | 72 | 69 | 71 | 70 | 72 | 72 |
| 1.6 g | G | $S_1$ Sensitivity | 67 | 65 | 69 | 74 | 74 | 72 | 74 | 73 | 70 | 75 |
| | | $S_2$ Sensitivity | 64 | 62 | 68 | 70 | 71 | 71 | 72 | 71 | 70 | 74 |
| | R | $S_1$ Sensitivity | 70 | 66 | 73 | 74 | 72 | 74 | 73 | 73 | 76 | 72 |
| | | $S_2$ Sensitivity | 70 | 66 | 71 | 74 | 72 | 72 | 73 | 72 | 75 | 70 |

It is found from the results shown in Table 3 that Samples No. 3 through 10 are little in desensitization even when a processing varies and excellent in processing stability. In particular, a processing variation range to blue-light is narrow. In addition to the above, in the samples of the invention, the characteristic values thereof to blue-, green- or red-light are well-assorted against a processing variation, and are hardly unbalanced in color when printing on printing paper.

What is claimed is:

1. A silver halide color photographic light-sensitive material comprising a support having arranged thereon at least two red-sensitive layers, at least two green-sensitive layers and at least two blue-sensitive layers, wherein with respect to the red-sensitive layers, there are not less than two silver halide emulsion layers having different sensitivities, wherein with respect to the blue-sensitive layers, there are not less than two silver halide emulsion layers having different sensitivities, and wherein with respect to the green-sensitive layers, there are not less than two silver halide layers having different sensitivities, said halide color photographic light sensitive material satisfying the following four requirements:

a. the highest blue-sensitive halide emulsion layer (BH) of said blue-sensitive layers is arranged to serve as the silver halide emulsion layer in the farthest position from said support;

b. the highest green-sensitive silver halide emulsion layer (GH) of said green-sensitive layers and the highest red-sensitive silver halide emulsion layer (RH) of said red-sensitive layers are interposed between said highest blue-sensitive silver halide emulsion layer (BH) and a lower blue-sensitive silver halide emulsion layer (Bh) having a sensitivity lower than said highest blue-sensitive silver halide emulsion layer (BH);

c. the lowest green-sensitive layer (GL) and the lowest red-sensitive layer (RL) are present between the support and said lower blue-sensitive silver halide emulsion layer (Bh); and d. a non-light-sensitive hydrophilic colloidal layer is arranged adjacent the surface of the highest blue-sensitive silver halide emulsion layer (BH) closer to said support, with at least one of said highest blue-sensitive silver halide emulsion layer (BH) and said colloidal layer containing substantially non-light-sensitive fine-grain silver halide particles.

2. The silver halide color photographic light-sensitive material according to claim 1, wherein the silver halide emulsion layers are arranged onto and from support in the order of a lower red-sensitive layer, a lower green-sensitive layer, a lower blue-sensitive layer, a higher red-sensitive layer, a higher green-sensitive layer and a higher blue-sensitive layer.

3. The silver halide color photographic light-sensitive material according to claim 1, wherein the layer described in the requirement d containing fine-grain silver halide is the blue-sensitive silver halide emulsion layer (BH).

4. The silver halide color photographic light-sensitive material according to claim 1, wherein the average grain size of the fine-grain silver halide described in the requirement d is from 0.03 μm to 0.5 μm.

5. The silver halide color photographic light-sensitive material according to claim 1, wherein the average grain size of the fine-grain silver halide described in the requirement d is from 0.05 μm to 0.4 μm.

6. The silver halide color photographic light-sensitive material according to claim 1, wherein the grain distribution of the fine-grain silver halide is monodispersive.

7. The silver halide color photographic light-sensitive material according to claim 1, wherein the blue-sensitive silver halide emulsion layer contains the fine-grain silver halide described in the requirement d in the proportion of from 5 wt% to 30 wt%.

8. The silver halide color photographic light-sensitive material according to claim 1, wherein the non-light-sensitive hydrophilic colloidal layer contains the fine-grain silver halide described in the requirement d in the proportion of from 2mg/dm$^2$ to 10mg/dm$^2$.

9. The silver halide color photographic light-sensitive material of claim 1, wherein with respect to the blue-sensitive layers, there are not less than three silver halide emulsion layers having different sensitivities, the lowest blue-sensitive layer (BL) being present between the support and the lower blue-sensitive silver halide emulsion layer (Bh).

10. The silver halide color photographic light-sensitive material of claim 1, wherein the highest blue-sensitive silver halide emulsion layer (BH) comprises a monodispersion type emulsion having a coefficient of variation $\sigma/\bar{\gamma}$ of not more than 0.2, wherein $\sigma$ represents the standard deviation of the silver halide grain distribution, and $\bar{\gamma}$ represents the average silver halide grain size.

* * * * *